US007712692B2

(12) United States Patent
Hall et al.

(10) Patent No.: US 7,712,692 B2
(45) Date of Patent: May 11, 2010

(54) ROTARY IMPACT MILL

(76) Inventors: David R. Hall, 2185 S. Larsen Pkwy., Provo, UT (US) 84606; Timothy Duke, 2185 S. Larsen Pkwy., Provo, UT (US) 84606

( * ) Notice: Subject to any disclaimer, the term of this patent is extended or adjusted under 35 U.S.C. 154(b) by 371 days.

(21) Appl. No.: 11/561,827

(22) Filed: Nov. 20, 2006

(65) Prior Publication Data

US 2008/0041993 A1 Feb. 21, 2008

Related U.S. Application Data

(63) Continuation-in-part of application No. 11/424,833, filed on Jun. 16, 2006, now Pat. No. 7,416,145.

(51) Int. Cl.
*B02C 13/28* (2006.01)

(52) U.S. Cl. ..... 241/197; 241/300

(58) Field of Classification Search ..... 241/197, 241/300

See application file for complete search history.

(56) References Cited

U.S. PATENT DOCUMENTS 3,045,934 A * 7/1962 Eilers ..... 241/197
4,605,343 A * 8/1986 Hibbs et al. ..... 407/119
4,638,747 A 1/1987 Brock
4,871,119 A * 10/1989 Murata et al. ..... 241/189.1
5,464,164 A * 11/1995 Doppstadt ..... 241/197
5,938,131 A 8/1999 Thom
5,950,945 A * 9/1999 Schaller ..... 241/189.1
6,405,950 B1 6/2002 Gunderson
2004/0129608 A1 7/2004 Clark

* cited by examiner

*Primary Examiner*—Mark Rosenbaum
(74) *Attorney, Agent, or Firm*—Tyson J. Wilde; Philip W. Townsend, III

(57) ABSTRACT

In one aspect of the invention, a rotary impact mill has a milling chamber defined by a housing with an inlet, an outlet, and at least one wall. A plurality of impact hammers located within the milling chamber are fastened to and longitudinally disposed along a rotor assembly that is connected to a rotary driving mechanism. At least one of the impact hammers has a plurality of inserts arranged adjacent one another in a row and attached to a body of the hammer, wherein a first end of at least one insert is complementary to a second end of an adjacent insert.

16 Claims, 9 Drawing Sheets

ROTARY IMPACT MILL

CROSS REFERENCES

This Patent Application is a continuation-in-part of U.S. patent application Ser. No. 11/424,833 filed on Jun. 16, 2006 now U.S. Pat. No. 7,416,145 and entitled Rotary Impact Mill, which is herein incorporated by reference in its entirety.

BACKGROUND OF THE INVENTION

Hammermills are often used to reduce the size of solid material. Materials often used in hammermills include coal, asphalt, cement, limestone, chemical fertilizer, barks, rocks, minerals, and food products. The materials are often fed into an inlet where the material falls into a milling chamber. The milling chamber typically comprises a plurality of impact hammers and may comprise a screen. The impact hammers are typically fastened at a proximal end to a rotary assembly; they are either rigidly fixed to the rotor assembly or the impact hammers may be free-swinging. As the material is fed into the chamber, the rotary assembly rotates bringing the impact hammers into contact with the material. The size reduction on each impact depends on the differential speed between the hammers and material, size of the material, and hardness of the material. If a screen is present, the screen may allow only the desired material particle size to pass to the outside of the chamber to an outlet where the particles can be collected or funneled to another machine where the material may be further processed.

Due to the impact and/or abrasive nature of the material, the impact hammers may wear requiring continual maintenance and down time of the hammermill.

U.S. Pat. No. 6,405,950 by Gunderson which is herein incorporated by reference for all that it contains, discloses an improved airflow hammermill assembly for grinding materials. The improved airflow hammermill assembly incorporates one or more diverging ducts communicating with the hammermill housing to provide a more uniform negative pressure within the housing. The improved airflow hammermill assembly allows increased throughput and energy savings.

U.S. Pat. No. 5,938,131 by Thom, Jr., et al., which is herein incorporated by reference for all that it contains, discloses a hammermill that includes a housing, a working chamber defined by a polygonal screen, an inlet to the chamber, an outlet and a plurality of free-swinging hammers attached to a driven rotor. Support brackets extend the length of the housing and mount deflectors for eliminating tangential motion of materials being comminuted in the working chamber in the region of the deflectors.

U.S. Pat. No. 4,638,747 by Brock, et al., which is herein incorporated by reference for all that it contains, discloses an invention that comprises a coal-fired burner system for use in a drum mix asphalt plant or drum dryer used for producing asphalt paving composition.

U.S. Patent Publication 2004/0129808 by Crane, et al., which is herein incorporated by reference for all that it contains, discloses a hammermill for singulating cellulosic fibers from a pulp sheet that comprises a cylindrical housing, a feed slot with a breaker bar positioned therein and a rotor mounted for rotation in the housing. Feed rolls are provided to feed a sheet of pulp into the feed slot upstream of the breaker bar.

BRIEF SUMMARY OF THE INVENTION

In one aspect of the invention, a rotary impact mill has a milling chamber defined by a housing with an inlet, an outlet, and at least one wall. A plurality of impact hammers located within the milling chamber are fastened to and longitudinally disposed along a rotor assembly connected to a rotary driving mechanism. At least one of the impact hammers has a plurality of inserts arranged adjacent one another in a row and attached to a body of the hammer, wherein a first end of at least one insert is complementary to a second end of an adjacent insert.

The inserts may be bonded proximate a distal end of the impact hammer whereas a proximal end is fastened to the rotor assembly. The inserts may comprise a generally rounded geometry, a generally conical geometry, a generally flat geometry, a generally hemispherical geometry, or a combination thereof The inserts may comprise a coating comprising diamond, polycrystalline diamond, cubic boron nitride, refractory metal bonded diamond, silicon bonded diamond, layered diamond, infiltrated diamond, thermally stable diamond, natural diamond, vapor deposited diamond, physically deposited diamond, diamond impregnated matrix, diamond impregnated carbide, cemented metal carbide, chromium, titanium, aluminum, tungsten, nitride, stelite, cobalt, manganese, or combinations thereof The inserts may be brazed or press fit into recesses of the hammer body and may be compressed together laterally. The inserts may comprise a hardness greater than the hardness of the hammer body.

The body of the impact hammer may comprise a plurality of rows of inserts. The plurality of rows of inserts may be arranged such that a gap between the plurality of inserts forms a pocket. The distal end of the impact hammer may comprise a plurality of faces with at least one face comprising a plurality of inserts. The distal end may comprise a strip of a wear resistant material with a hardness of at least 60 HRc. The strip may be adjacent the plurality of inserts. The distal end of the impact hammer may comprise a distal surface opposite the proximal end and substantially normal to the axial length of the body. This normal distal surface may comprise a hard surface.

The wear resistant inserts may protrude beyond the body of the impact hammer 0.010 to 3.00 inches. The inserts may be generally flush with the body of the impact hammer. The inserts may comprise a first end which is flat, angular, slanted, curved, rounded or combinations thereof. The inserts may comprise first and second ends which are generally planar and where first ends are angled so as to be generally parallel to the second ends of the adjacent inserts. The inserts may have first and second ends which are generally planar and angled. The first and second ends of inserts may be generally non-planar. The inserts may have all first ends that are angled with the same angle and all second ends with angles complementary to the angle of the first ends.

DETAILED DESCRIPTION OF THE INVENTION AND THE PREFERRED EMBODIMENT

Figure 1:
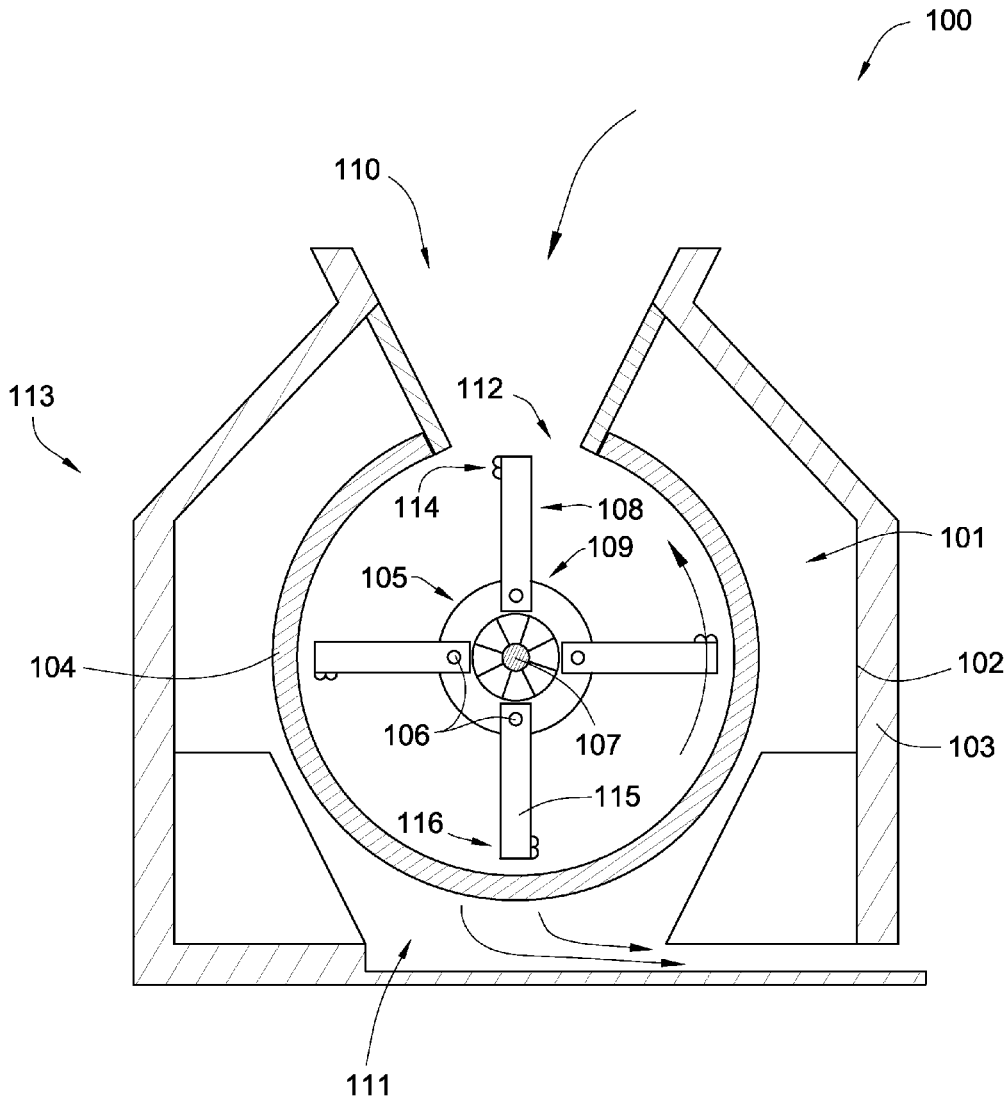
FIG. 1 is a cross sectional diagram of an embodiment of a rotary impact mill.

FIG. 1 is a cross sectional diagram of an embodiment of a rotary impact mill 100. A milling chamber 101 is defined by at least one wall 102 of a housing 103 which may support an internal screen 104, which is typically cylindrical or polygonal. Within the screen 104 a rotary assembly 105 comprises a plurality of shafts 106 connected to a central shaft 107 which is in turn connected to a rotary driving mechanism (not shown). The rotary driving mechanism may be a motor typically used in the art to rotate the rotor assembly of other hammermills. Although there are four shafts 106 shown, one, two, or any desired number of shafts may be used. A plurality of impact hammers 108 are longitudinally spaced and connected to each of the shafts 106 at the hammer's proximal end 109. The hammers 108 may be rigidly attached to the shafts 106 or the hammers 108 may be free-swinging. In some embodiments, the rotor assembly 105 comprises just the central shaft 107 and the impact hammers 108 are connected to it.

The housing 103 also comprises an inlet 110 and an outlet 111. Typically the inlet 110 is positioned above the rotor assembly 107 so that gravity directs the material towards it through an opening 112 in the screen 104, although the inlet 110 may instead be disposed in one of the sides 113 of the housing 103. When in the milling chamber 101, a material may be reduced upon contact with the impact hammers 108. The screen 104 may comprise apertures (not shown) only large enough to allow the desired maximum sized particle through. Upon impact however, a distribution of particle sizes may be formed, some capable of falling through the apertures of the screen 104 and others too large to pass through. Since the larger particle sizes may not be able pass through the apertures, they may be forced to remain within the screen 104 and come into contact again with one of the impact hammers 108. The hammers 108 may repeatedly contact the material until they are sized to pass through the apertures of the screen 104.

After passage through the screen 104 the size-reduced particles may be funneled through the outlet 111 for collection. In other embodiments the particles may be directed towards another machine for further processing, such as when coal is the material being reduced and fine coal particles may be directed towards a furnace for producing power. It may be necessary to provide low pressure in the vicinity of the outlet 111 to remove the particles, especially the fine particles, through the outlet 111. The low pressure may be provided by a vacuum.

As shown in FIG. 1, the rotor assembly 105 is positioned such that it is substantially perpendicular to the flow of material fed into the inlet 110. In other embodiments, the rotor assembly 105 may be positioned such that it is substantially parallel or diagonally disposed with respect to the flow of feed material. In some embodiments, there are multiple rotor assemblies.

The impact hammers 108 comprise a plurality of wear resistant inserts 114 bonded to a body 115 of the impact hammer 108. At least one of the inserts 114 has a first end which is complementary to a second end of an adjacent insert 114. Although the embodiment of an impact hammer 108 in FIG. 1 comprises a generally rectangular shape, the impact hammer 108 may comprise any general shape including, but not limited to generally cylindrical, generally triangular, tapers, beveled, generally conical, generally stepped, or combinations thereof. In some embodiments of the present invention, the hammer is a bar hammer, a T-shaped hammer, a ring-type hammer, a toothed type-ring hammer or combinations thereof. The wear resistant inserts 114 are believed to reduce wear of the hammer body 115. The body 115 of the hammers may be made of steel, stainless steel, a cemented metal carbide, manganese, hardened steel, metal, hardox 600, or combinations thereof Typically hardened steel is used. The distal end 116 of the hammer body 115 is typically more susceptible to wear because it travels the farthest distance per rotation of the rotor assembly 105 causing the distal end 116 to travel at a higher velocity than the rest of the hammer body 115 and causing it to be more susceptible to wear. Although other regions of the hammer body may be less susceptible to wear, they may still come into contact with the material being reduced and may benefit from having a wear resistant insert bonded to it.

Figure 2:
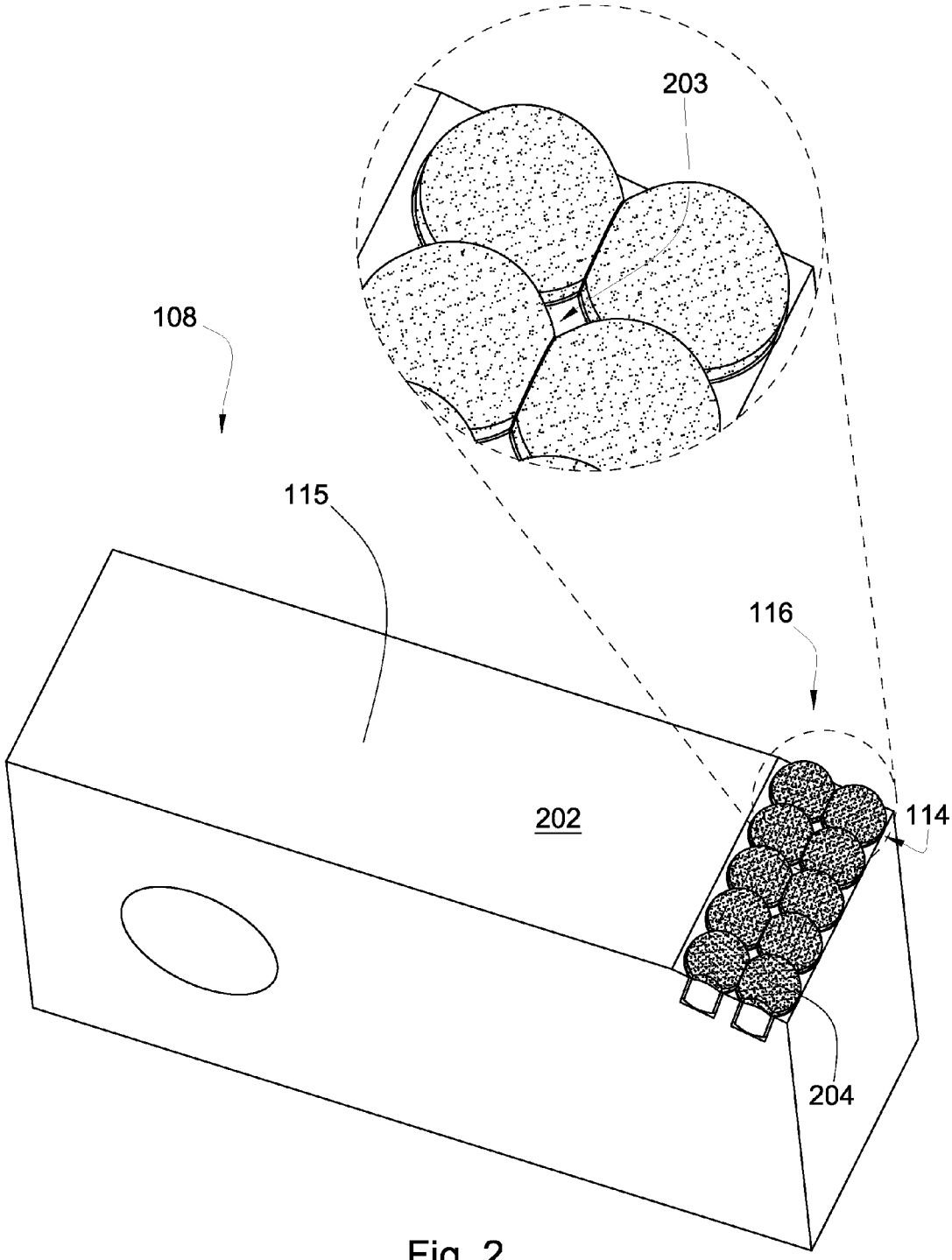
FIG. 2 is a perspective diagram of an embodiment of an impact hammer.

FIG. 2 is a perspective diagram of a preferred embodiment of an impact hammer 108 and discloses a plurality of domed inserts 114 bonded proximate the distal end 116 of the hammer body 115. Though FIG. 2 discloses domed inserts, the inserts may comprise a generally rounded geometry, a generally conical geometry, a generally flat geometry, a generally hemispherical geometry, or a combination thereof Impacting the material with a domed insert 114 may generate a more explosive impact than a sharper insert. The desired balance of blunt inserts to sharp inserts would depend on the type of material being reduced, the rate that material is fed into the milling chamber, and the differential speed between the material and insert. At least one of the inserts 114 comprises a first end which is complementary to a second end of an adjacent insert 114.

The distal end 116 may comprise a single row of inserts 114, or as disclosed in FIG. 2, a plurality of rows of inserts 114. The inserts may comprise a hardness greater than the hardness of the hammer body 115. Cavities may be formed in the body 115 on the impact side 202 of the body 115. The inserts 114 may be brazed within the cavities or press fit. The inserts 114 may be brazed using a braze material comprising silver, gold, copper, nickel, palladium, boron, chromium, silicon, germanium, aluminum, iron, cobalt, manganese, titanium, tin, gallium, vanadium, indium, phosphorus, molybdenum, platinum, or combinations thereof. In some embodiments, where the inserts 114 are brazed in, there may be a gap of 0.005 to 0.040 inches between the inserts at the narrowest point. Press fitting the inserts 114 together in a row where the first and second ends press against each other may cause the inserts to compress together laterally.

The wear resistant inserts 114 may be of a solid material or a combination of materials. Preferably the insert 114 comprises the combination of a cemented metal carbide substrate with a superhard coating 204 bonded to it, such as polycrystalline diamond. However, the insert 114 may also comprise a coating 204 selected from the group comprising diamond, polycrystalline diamond, cubic boron nitride, refractory metal bonded diamond, silicon bonded diamond, layered diamond, infiltrated diamond, thermally stable diamond, natural diamond, vapor deposited diamond, physically deposited diamond, diamond impregnated matrix, diamond impregnated carbide, cemented metal carbide, chromium, titanium, aluminum, tungsten, and combinations thereof. The coating 204 of solid hard materials, in some cases, may be made harder by doping or infiltrating the materials with higher or lower concentrations of metals and/or hard materials to achieve a desired hardness. The hardness of the coating 204 may have a hardness greater than the hardness of the hammer body 115. In some embodiments, the hammer body 115 has a hardness of 35 to 50 HRc. Preferably the insert substrates have a hardness of at least 60 HRc, and the superhard coating has a hardness of at least 2000 HK.

The coating 204 may be bonded to the substrate with a non-planar interface to increase the strength of the bond. Also the superhard material may be a sintered body, such as in embodiments where a polycrystalline diamond is used, and may be made thermally stable by removing a thin layer of metal binders by leaching in the hard surface. It is believed that the thin layer of metal binders may have a higher coefficient of thermal expansion than the grains of the superhard material. In other embodiments, the hard surface may comprises a metal binder concentration less than 40 weight percent. In embodiments where polycrystalline diamond is used, a higher concentration of cobalt typically reduces the brittleness of the polycrystalline diamond but as a tradeoff increases its susceptibility to wear. Preferably the polycrystalline diamond has a cobalt concentration of four to ten weight percent. Adjusting the metal binder concentration in the cemented metal carbide may also have the same effect. Preferably the carbide is a tungsten carbide comprising a cobalt concentration of 6 to 14 weight percent. Polycrystalline diamond grain size distribution may also play an important role in the strength of the diamond and also in its failure mode. Preferably, the grain sizes are within 0.5 to 300 microns. Preferably, the coating 204 is also polished to reduce crack initiation starting points that may be created during manufacturing. Although several preferred characteristics have been identified, any concentrations and characteristics of coatings 204 are encompassed within the claims.

In some embodiments a gap between a plurality of inserts forms a pocket 203. It is believed that when material is fed through the mill that the pocket 203 fills with material. This material in the pocket 203 is believed to protect the body 115 of the impact hammer 108 between the inserts 114

Figure 3:
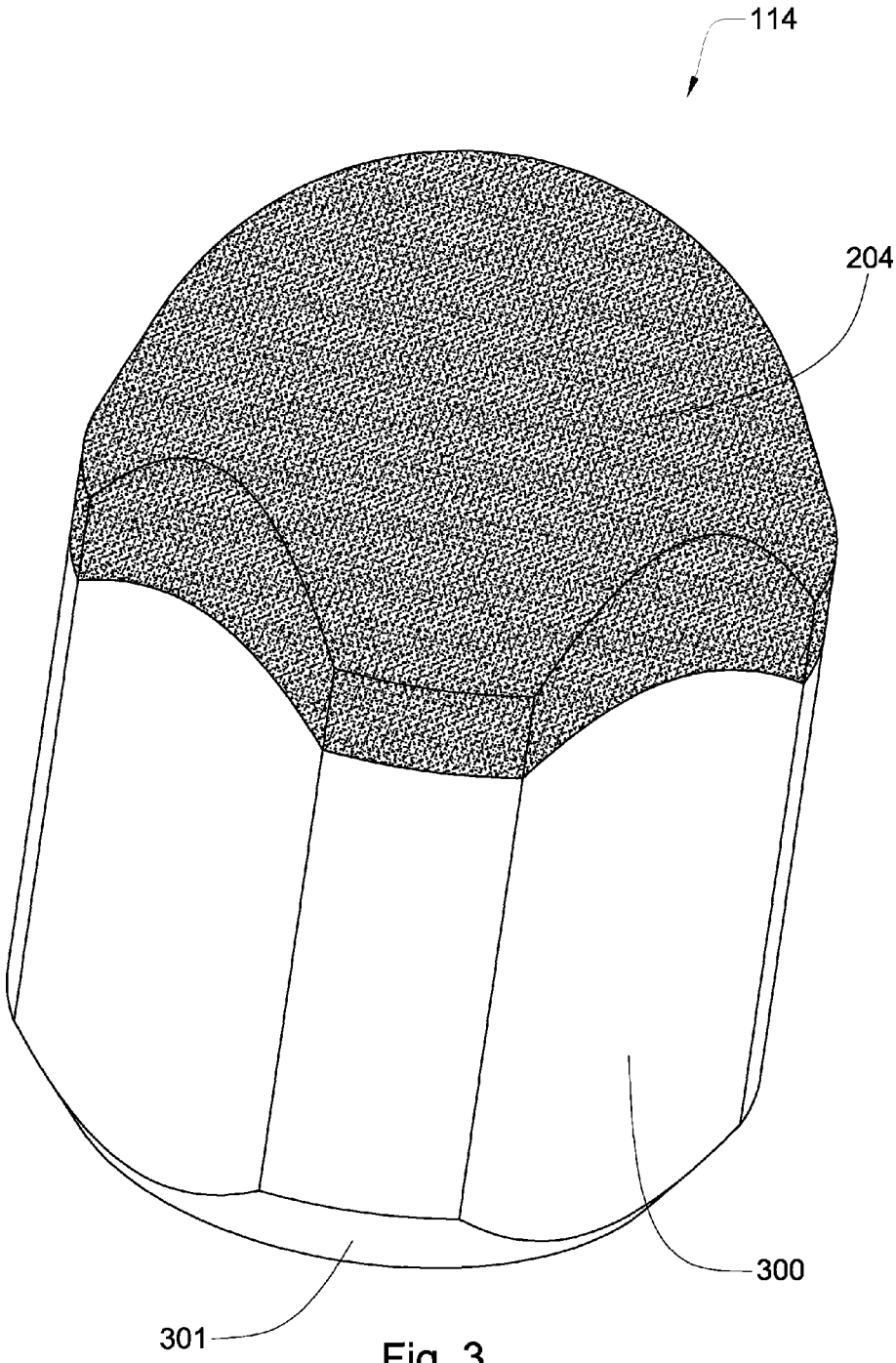
FIG. 3 is a perspective diagram of an embodiment of an insert.

In FIG. 3 a perspective embodiment of an insert 114 is shown with a first end 300 that is generally flat and complementary to a second end of an adjacent insert. The flat first end 300 allows inserts 114 to be positioned close together. In this way the wear between inserts 114 is reduced by substantially eliminating the momentum of material flowing between the inserts 114. Because inserts 114 with a diamond coating 204 have a much greater wear resistance than the body 115 of the hammer, wear occurs around the inserts 114 before the inserts 114 wear themselves. Therefore it is believed that by reducing the amount and velocity of aggregate impacting on the body 115 proximate the inserts the overall life expectancy of the hammer 108 will increase. A radius 301 or conic is shown opposite the coating 204. An insert 114 may comprise any combination of flatted ends in order to be complementary to adjacent inserts.

Figure 4:
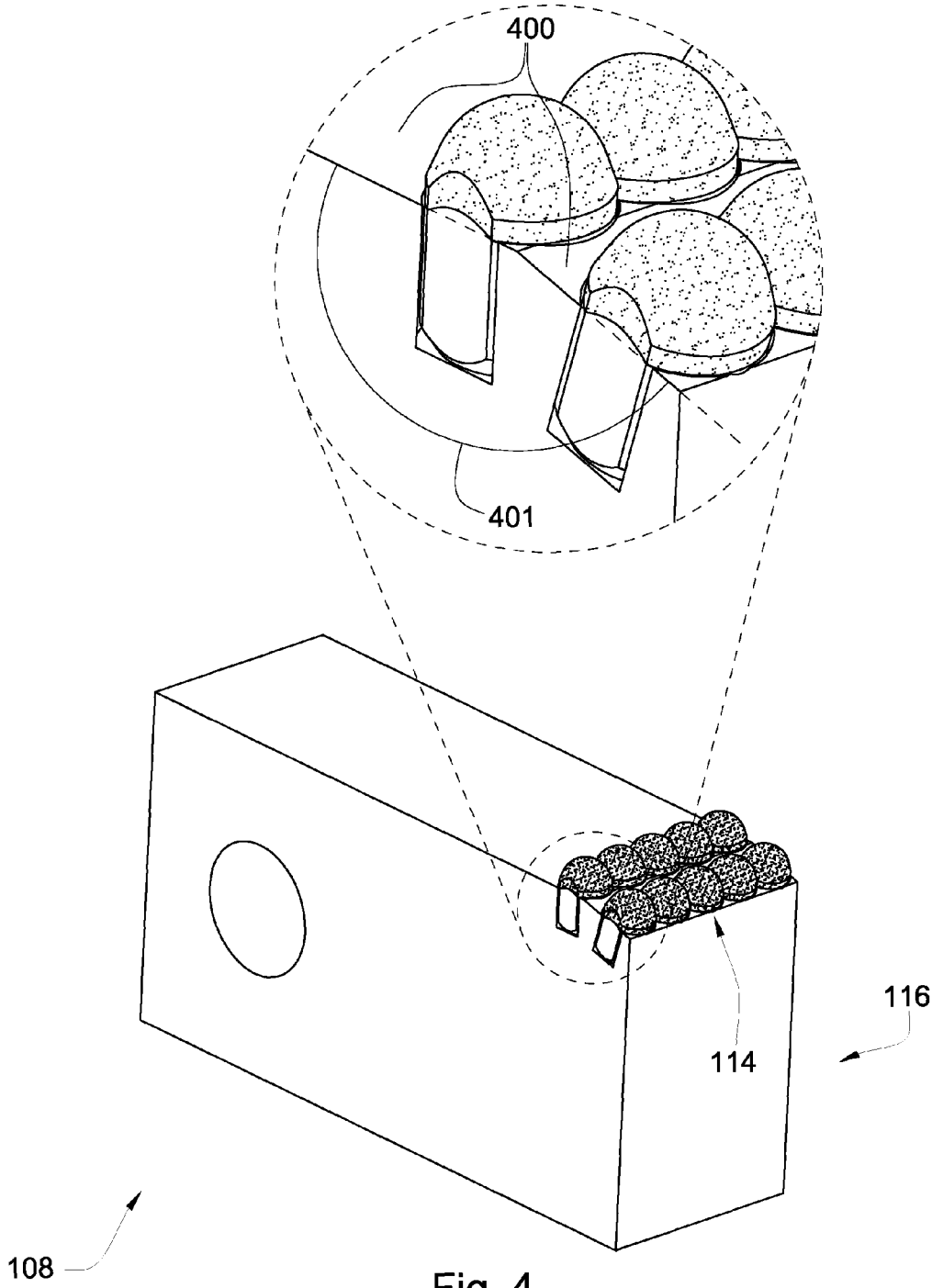
FIG. 4 is a perspective diagram of another embodiment of an impact hammer.

FIG. 4 discloses an embodiment of a hammer 108 where a plurality of faces 400 is disposed on the distal end 116. By adjusting the angle between the plurality of faces 400 the angle of impact between the insert 114 and the material can be adjusted. It is believed that different face angles 401 may adjust the aggressiveness of the impact. By using multiple faces it is believed that impact angles may be manipulated to achieve maximal crushing effect on the material without creating undue wear on the inserts 114.

Figure 5:
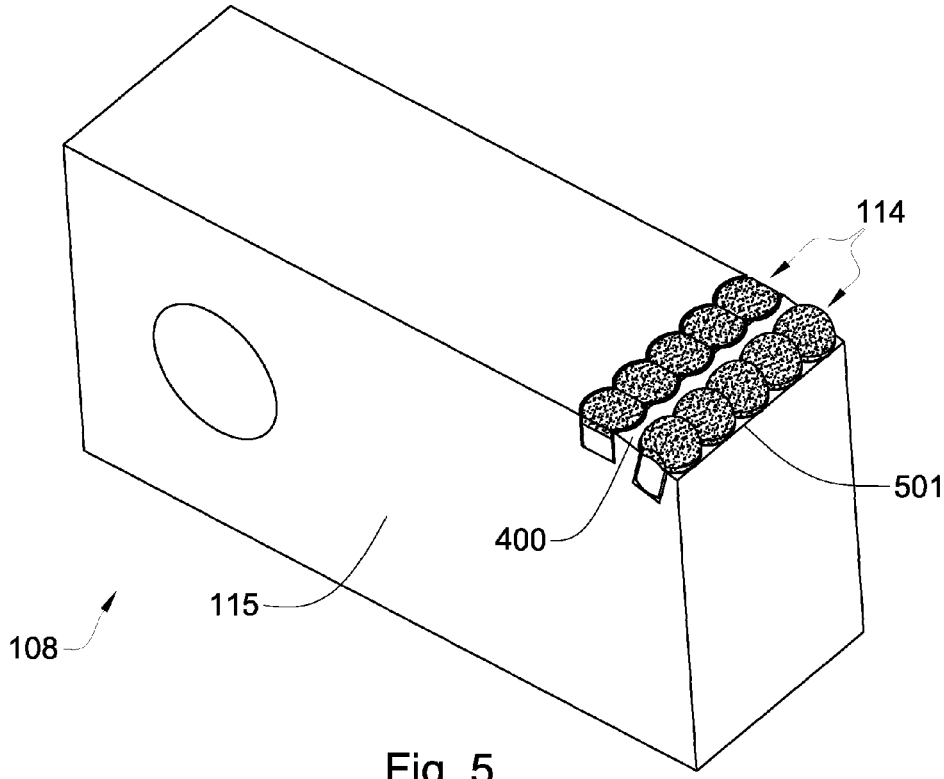
FIG. 5 is a perspective diagram of another embodiment of an impact hammer.

FIG. 5 discloses an embodiment of a hammer 108 where the inserts 114 may protrude from a face 400 by 0.010 to 3.00 inches. It is believed that protruding inserts 114 may create a bending moment on impacting material. This bending moment is believed to more effectively break the material Inserts 114 with a generally rounded geometry are believed to contribute to the bending moment. In addition, it is believed that the generally rounded inserts are less susceptible to chipping from contaminants in the material feed. It is believed that chipping of the inserts 114 occurs proximate the edge 501 of the distal end 116 of the hammer 108. Rounded inserts 114 may resist the chipping. In some embodiments the hammer 108 has rounded inserts 114 near the edge 501 in combination with flat inserts 114 placed more proximal on the hammer. In some embodiments the inserts 114 may not protrude from the face 400, but may be flush with the face 400. In some embodiments, the inserts may be simply bonded to a flat surface of the body 115.

Figure 6:
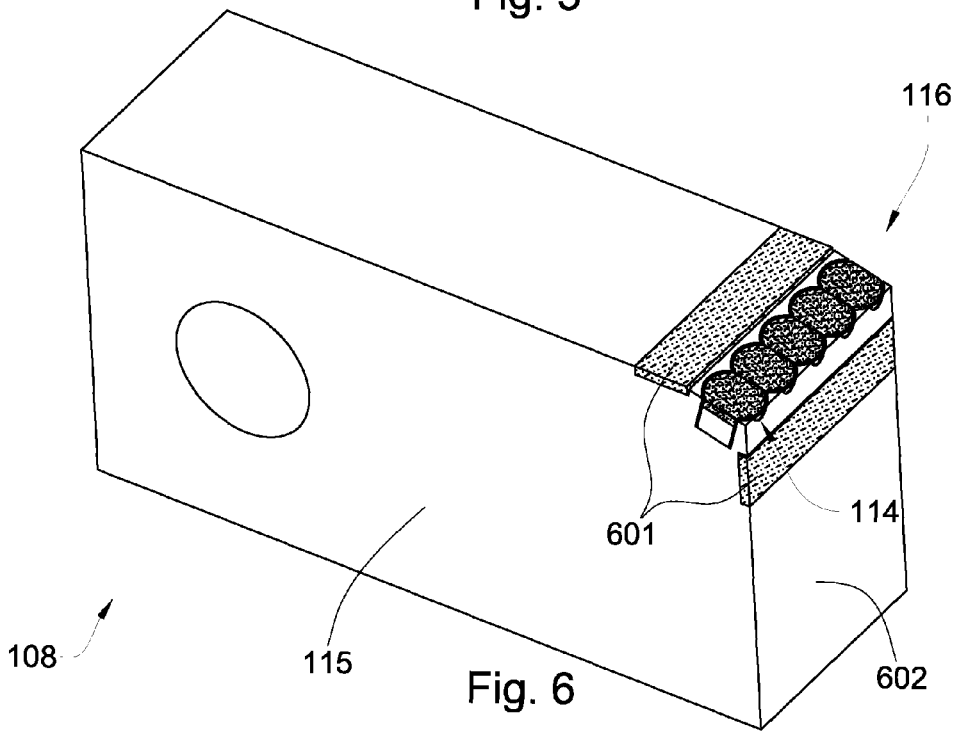
FIG. 6 is a perspective diagram of another embodiment of an impact hammer.

Referring now to FIG. 6, in some embodiments of the invention a rectangular strip 601 of hard material at high wear regions of the hammer 108 may provide wear resistance, allowing for protection from impact and shearing forces due to the flow of material. In some embodiments, the strip 601 may be segmented. The strip 601 may be casted or molded prior to fastening and/or bonding it to the hammer 108. Graphite or ceramics may be placed in the casted or molded material such that holes are formed in the strip 601 and the inserts 114 may be brazed or press fit into them. The strip 601 may be adjacent the plurality of inserts 114 in more than one direction and may be disposed between rows of inserts 114. By positioning the strip 601 in areas of high wear around the inserts 114 the wear resistance of the hammer 108 may be increased without increasing the number of inserts 114. In some embodiments the strip 601 may be disposed on a distal surface 602 opposite the proximal end and substantially normal to the axial length of the body 115. In some aspects of the invention the distal surface 602 may comprise a plurality of inserts 114. This may be advantageous for reducing wear of the distal end 116 of the hammer 108 in situations where the distal end 116 of the hammer body 108 comes into contact with the screen 104 (see FIG. 1) or if a material particle braces itself between the screen 104 and the hammer 108.

Figure 7:
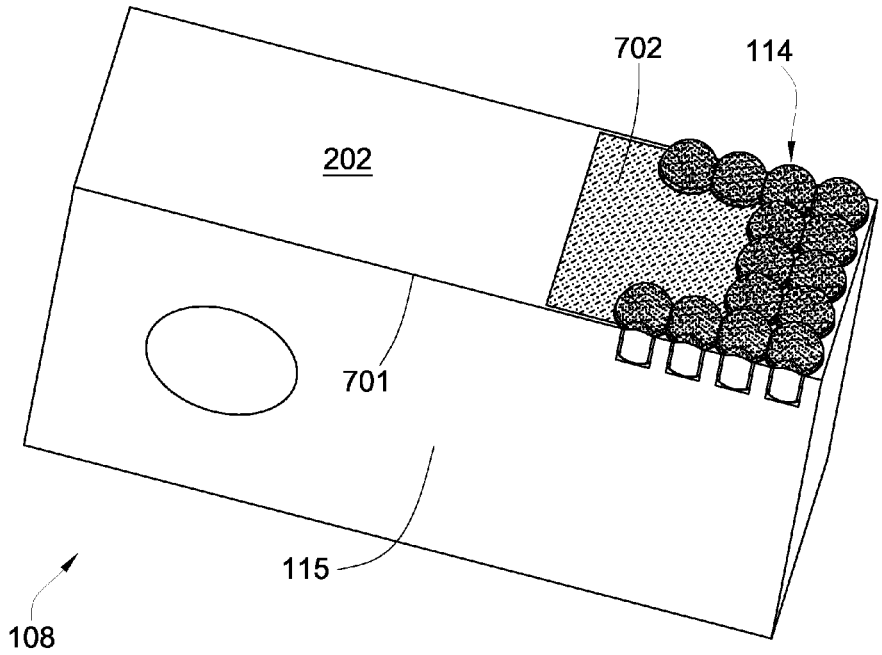
FIG. 7 is a perspective diagram of another embodiment of an impact hammer.

Referring now to FIG. 7, the distal end 116 may comprise a plurality of inserts 114 disposed along a longitudinal edge 701 of the body 115. In addition to the distal end 116 of the impact side 202, the longitudinal edges 701 of the hammer 108 may also experience great amounts of wear. It is believed that placing inserts along the longitudinal edge 701 will reduce the wear along those edges 701 and increase the life expectancy of the hammer 108. A hard surface 702 may be disposed adjacent the plurality of inserts in any direction in order to protect the body 115 from wear without increasing the number of inserts. In some embodiments, the hard surface 702 comprises carbide. Also in certain embodiments, the hard surface matches the profile of inserts.

Figure 8:
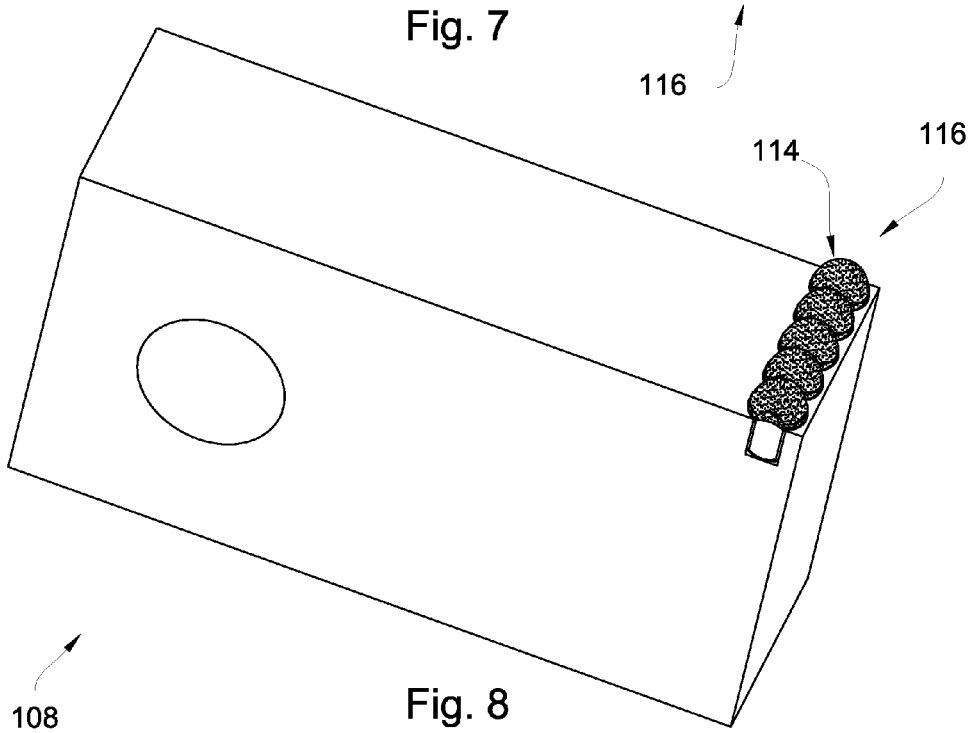
FIG. 8 is a perspective diagram of another embodiment of an impact hammer.

Referring now to FIG. 8 the distal end 116 of the hammer 108 may comprise a single row of inserts 114. The production cost of hammers 108 may be correlated to the number of inserts 114 on the hammer 108. In applications of the invention that cause less wear it may be advantageous to have only one row of inserts 114.

Figure 9:
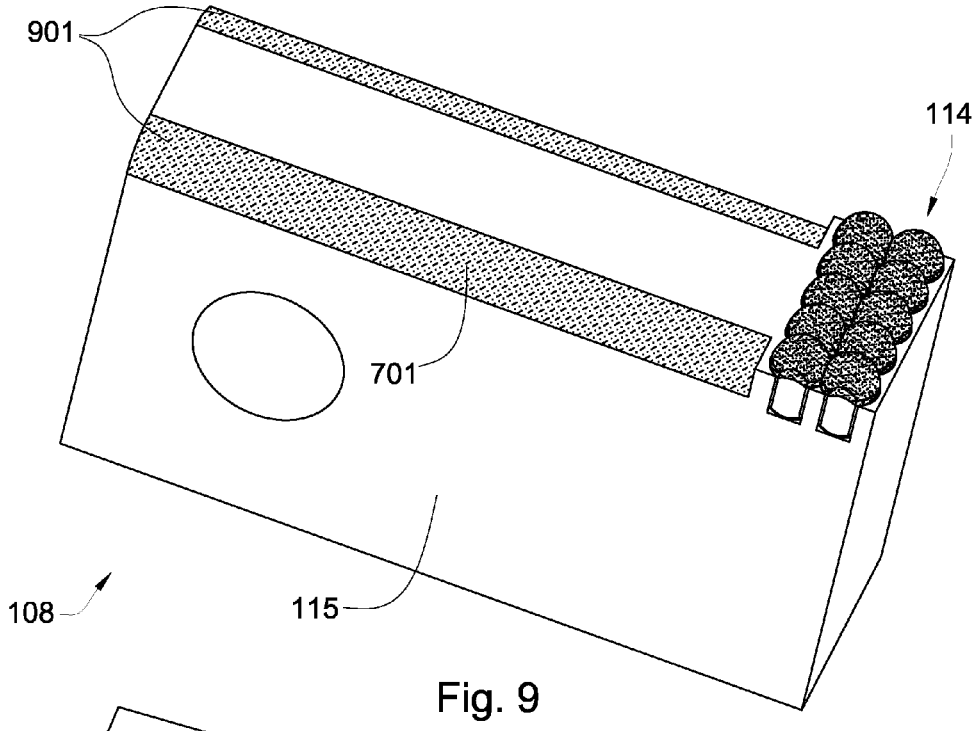
FIG. 9 is a perspective diagram of another embodiment of an impact hammer.

Referring now to FIG. 9, the body 115 may comprise a plurality of longitudinal wear resistant plates 901. Material particles may pass over the longitudinal edges 701 and cause them to be susceptible to wear. In some applications the longitudinal wear plates 901 may be sufficient to reduce wear in that region. Although the embodiment of FIG. 9 discloses a long single solid wear resistant plate 901 bonded to a longitudinal edge 701, in other embodiments smaller plates may be positioned adjacent one another along the edge 701. Furthermore, any geometry of plates may be used. These wear plates 901 may be disposed adjacent a plurality of inserts 114. Preferable a longitudinal wear plate 901 is as close to its longitudinal edge 701 as possible. To achieve this, the plate 901 may be bonded to the body 115 such that a small portion of the plate 901 hangs over the edge 701, which overhang is then removed by grinding. The overhang may be allowable, depending on the spacing of the impact hammers 108 along the rotor assembly 105 (See FIG. 1). If the overhang doesn't interfere with adjacent longitudinally spaced hammers, the grinding step may not be necessary. In some embodiments, the edge 701 may be rounded or chamfered.

Figure 10:
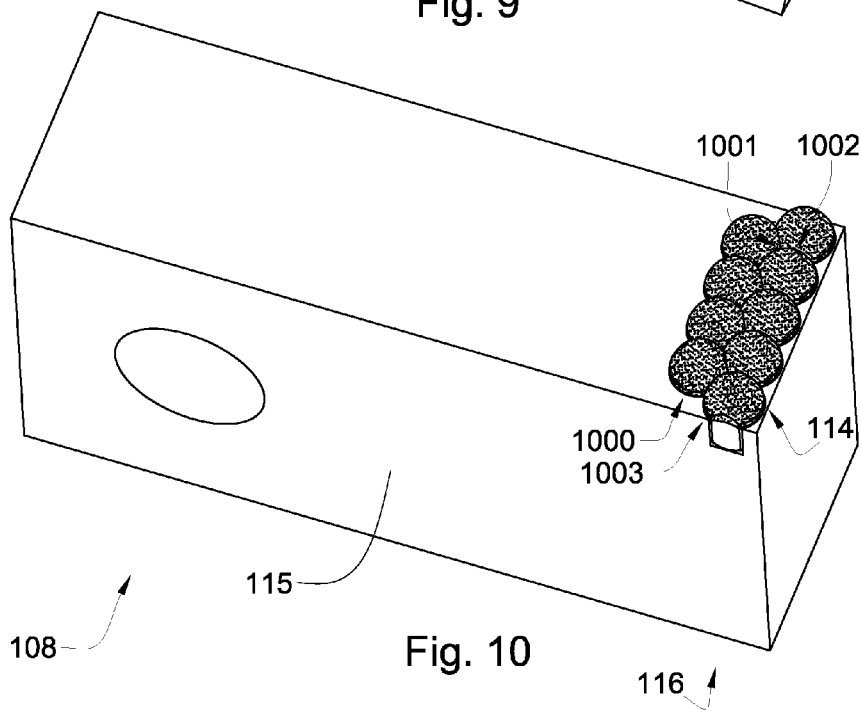
FIG. 10 is a perspective diagram of another embodiment of an impact hammer.

Referring now to FIG. 10, the distal end 116 of the hammer 108 may comprise a first row 1000 of inserts 114 that each have an end 1001 complementary to a junction 1002 of inserts 114 in a second row 1003. It is believed that the momentum of material flow between inserts 114 causes wear. By offsetting the first and second row the momentum of material flow between inserts will be substantially eliminated. The first row 1000 of inserts 114 may also be disposed such that a gap is formed at the junction 1002 of the three inserts. The arrangement of the first row 1000 of inserts 114 at the junctions 1002 of the second row 1003 of inserts may be desirable when a fewer number of inserts 114 provides adequate protection for the distal end 116.

Figure 11:
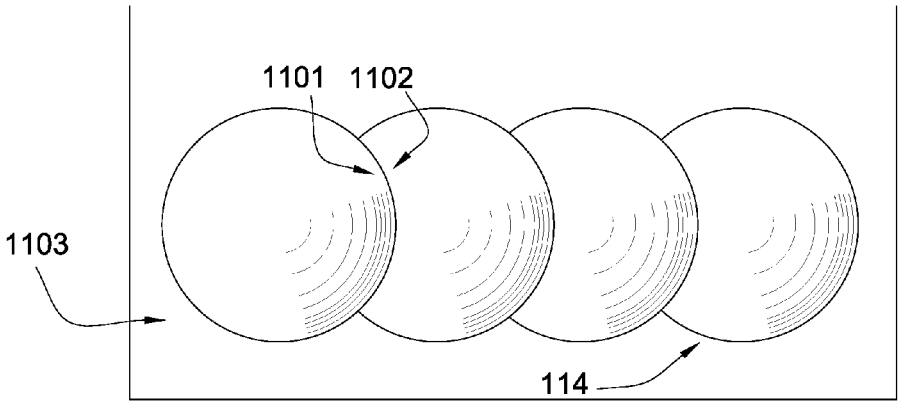
FIG. 11 is an orthogonal diagram of an embodiment of a row of inserts.
Figure 12:
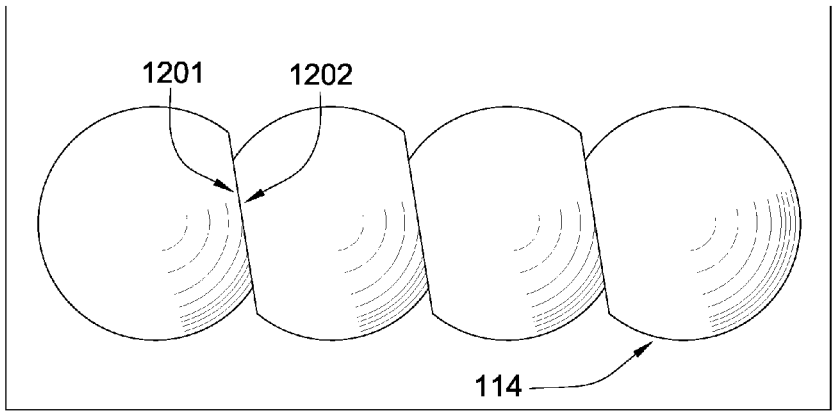
FIG. 12 is an orthogonal diagram of another embodiment of a row of inserts.
Figure 13:
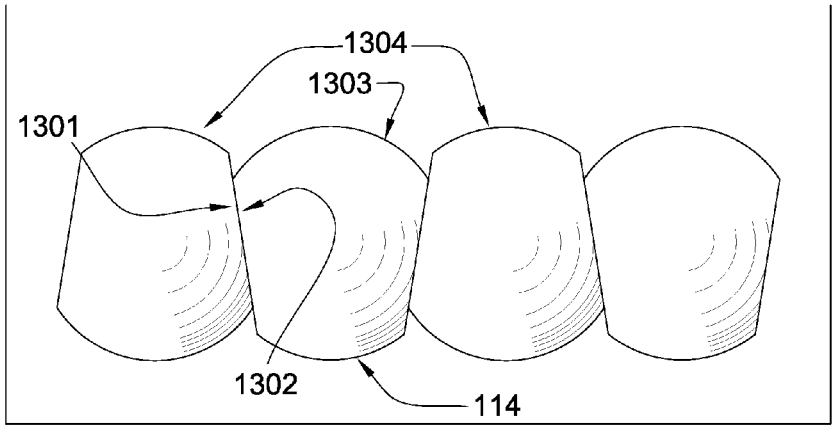
FIG. 13 is an orthogonal diagram of another embodiment of a row of inserts.
Figure 14:
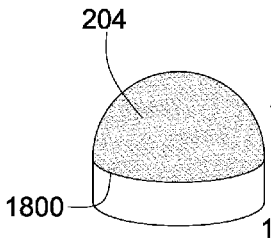
FIG. 14 is a perspective diagram of an embodiment of an insert.
Figure 15:
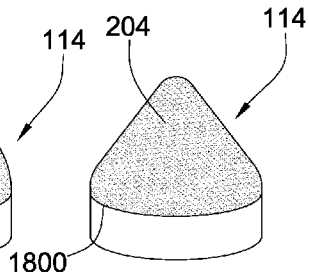
FIG. 15 is a perspective diagram of another embodiment of an insert.
Figure 16:
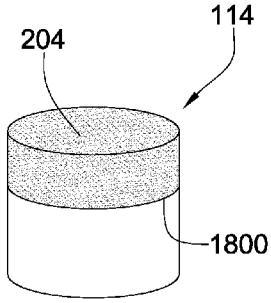
FIG. 16 is a perspective diagram of another embodiment of an insert.
Figure 17:
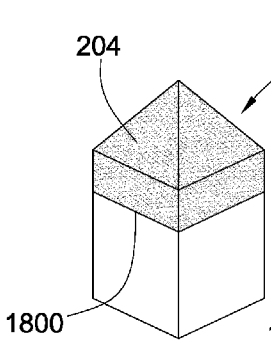
FIG. 17 is a perspective diagram of another embodiment of an insert.
Figure 18:
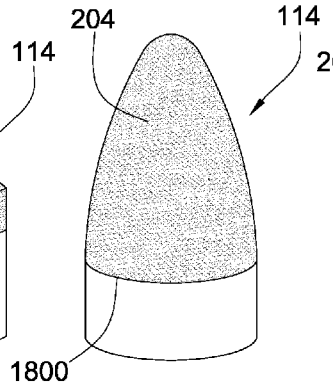
FIG. 18 is a perspective diagram of another embodiment of an insert.
Figure 19:
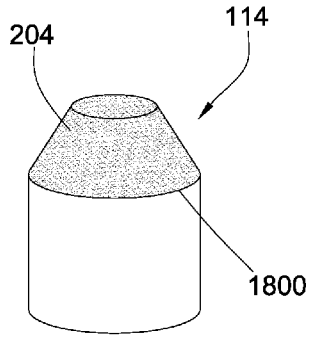
FIG. 19 is a perspective diagram of another embodiment of an insert.
Figure 20:
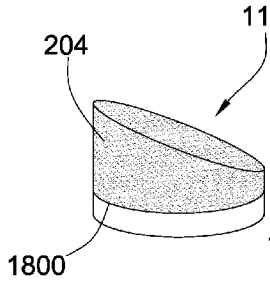
FIG. 20 is a perspective diagram of another embodiment of an insert.
Figure 21:
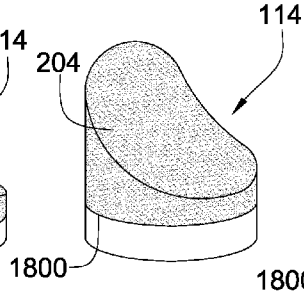
FIG. 21 is a perspective diagram of another embodiment of an insert.
Figure 22:
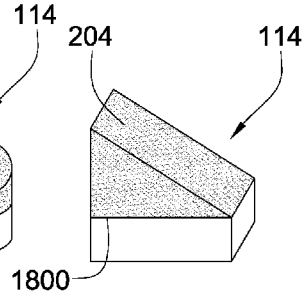
FIG. 22 is a perspective diagram of another embodiment of an insert.

FIGS. 11 to 13 are different embodiments of first and second complementary ends of the inserts 114. The inserts 114 may have a first end which is flat, angular, slanted, curved, rounded or combinations thereof. FIG. 11 is an embodiment of a row of inserts in which a first end 1101 is generally rounded complementary to a second end 1102 of an adjacent insert 114. Since the first end 1101 is interlocked with the second end 1102 it is believed that an impact to one of the inserts will be shared by its adjacent inserts. By distributing the force of aggregate impact throughout an entire row 1103 it is believed that the inserts 114 will have a greater resistive force and a longer life. Additionally, the complementary first and second ends 1101, 1102 serve to reduce the space between the inserts 114 thus reducing the amount of aggregate flowing between the inserts 114.

FIG. 12 is an embodiment of a row of inserts 114 in which all of the first ends 1201 are generally planar and angled with the same angle and are complementary to the second ends 1202 of an adjacent inserts. This design not only attempts to reduce wear by reducing the space between the inserts 114 but is also believed to change the flow between the inserts, which will reduce the energy of the flowing material. It is therefore believed that the embodiment of inserts 114 shown in FIG. 12 will cause a reduction in the momentum of aggregate flowing between the inserts 114.

FIG. 13 is an embodiment of a row of inserts 114 in which a first end 1301 is generally planar and angled complementary to a second end 1302 of an adjacent insert 114. This arrangement creates a middle insert 1303 that comprises a wedge between two adjacent inserts 1304.

FIGS. 14-22 all disclose various embodiments of geometries of the inserts 114. Each geometry may be advantageous depending on the material and application of the rotary impact mill. These inserts may be bonded or otherwise attached anywhere on the hammer body, although they are preferably attached proximate its distal end. In embodiments, where the rotation of the rotor assembly is reversible, it may be beneficial to have the wear resistant inserts bonded to the side of the body opposite of the impact side. The insert 114 may comprise a geometry with a generally domed shape, as in the embodiment of FIG. 14; a generally conical shape, as in the embodiment of FIG. 15; a generally flat shape, as in the embodiment of FIG. 16; a generally pyramidal shape, as in the embodiment of FIG. 17; a generally paraboloid shape, as in the embodiment of FIG. 18; a generally frustoconical shape, as in the embodiment of FIG. 19; an elliptical wedge shape, as in the embodiment of FIG. 20; a generally scoop shape, as in the embodiment of FIG. 21; a rectangular wedge shape, as in the embodiment of FIG. 22; a generally asymmetric shape; a generally rounded shape; a generally polygonal shape; a generally triangular shape; a generally rectangular shape; a generally concave shape; a generally convex shape; a chamfer; a conic section; or combinations thereof. The diamond surface 204 may be bonded to a substrate in a high temperature high pressure press at a planar or non-planar interface 1800 of the insert 114. Preferably the diamond surface is a cobalt infiltrated polycrystalline diamond bonded to a tungsten carbide substrate.

Whereas the present invention has been described in particular relation to the drawings attached hereto, it should be understood that other and further modifications apart from those shown or suggested herein, may be made within the scope and spirit of the present invention.

What is claimed is:

1. An impact hammer, comprising:

a body with a first end adapted for attachment to a substantially normal shaft and a second end comprising a plurality of inserts arranged adjacent one another in a row and attached to a surface of the hammer;

wherein the plurality of inserts comprise a generally cylindrical shape and a flat surface parallel to a central axis of the insert; and wherein a first end of at least one insert is interlocked with a second end of an adjacent insert and wherein the first and second ends are angled to change a flow of material between them causing a reduction in the flow's momentum.

2. The hammer of claim 1, wherein a proximal end of the impact hammer is fastened to a rotor assembly and a wear resistant insert is bonded proximate a distal end of the hammer.

3. The hammer of claim 1, wherein the inserts comprise a coating selected from the group comprising diamond, polycrystalline diamond, cubic boron nitride, refractory metal bonded diamond, silicon bonded diamond, layered diamond, infiltrated diamond, thermally stable diamond, natural diamond, vapor deposited diamond, physically deposited diamond, diamond impregnated matrix, diamond impregnated carbide, cemented metal carbide, chromium, titanium, aluminum, tungsten, and combinations thereof.

4. The hammer of claim 1, wherein the plurality of inserts is brazed or press fit into recesses of the hammer body.

5. The hammer of claim 1, wherein the inserts are compressed together laterally.

6. The hammer of claim 1, wherein the insert comprises a hardness greater than the hardness of the hammer body.

7. The hammer of claim 1, wherein the hammer body comprises a plurality of rows of inserts.

8. The hammer of claim 1, wherein a gap between a plurality of inserts forms a pocket.

9. The hammer of claim 1, wherein at least the distal end of the hammer comprises a plurality of faces, at least one of the faces comprising a plurality of inserts.

10. The hammer of claim 1, wherein the distal end comprises a strip of a wear resistant material with a hardness of at least 60 HRc, the strip being adjacent the plurality of inserts and being attached to the distal ends.

11. The hammer of claim 1, wherein the distal end of the hammer body comprises a distal surface opposite the proximal end and substantially normal to the axial length of the body, wherein the distal surface comprises a hard surface.

12. The hammer of claim 1, wherein the wear resistant insert protrudes beyond the body by 0.010 to 3.00 inches.

13. The hammer of claim 1, wherein a wear resistant insert is generally flush with the body of the hammer.

14. The hammer of claim 1, wherein the first end of an insert is flat, angular, slanted, curved, rounded or combinations thereof.

15. The hammer of claim 1 wherein of the first and second ends of the inserts are generally planar and are angled.

16. The hammer of claim 1 wherein all of the first ends of the inserts are angled with the same angle and all of the second ends of the inserts are angled with the complementary angle.

* * * * *